United States Patent [19]

Zefran

[11] 4,219,119

[45] Aug. 26, 1980

[54] DECORATIVE CAKE CONTAINER

[76] Inventor: Clara M. Zefran, 1328 Monomoy 10A, Aurora, Ill. 60506

[21] Appl. No.: 847,225

[22] Filed: Oct. 31, 1977

[51] Int. Cl.[3] ..... B65D 85/00; G09F 3/10

[52] U.S. Cl. ..... 206/457; 40/307; 220/353; 312/284; D7/83; D9/205

[58] Field of Search ..... D7/83; D9/23, 195, 205; 40/306–307, 312–313; 206/457; 220/297, 353; 312/280, 284

[56] References Cited

U.S. PATENT DOCUMENTS

| | | | |
|---|---|---|---|
| D. 157,043 | 1/1950 | Gruber et al. | D9/205 |
| D. 183,456 | 9/1958 | Henderson et al. | D9/205 |
| 1,125,855 | 1/1915 | Mapes | 312/284 |
| 2,203,540 | 6/1940 | Montgomery | 312/284 X |
| 2,347,041 | 4/1944 | Filsinger | D7/83 X |
| 2,758,458 | 8/1956 | Carlson | 312/284 X |
| 2,852,054 | 9/1958 | Motley | 40/307 X |
| 2,997,788 | 8/1961 | Gilbert | 206/457 X |
| 3,076,577 | 2/1963 | Craig | 220/297 |
| 3,204,359 | 9/1965 | Kurokawa | 40/307 |
| 3,819,455 | 6/1974 | MacKendrick | 312/284 X |

*Primary Examiner*—Stephen Marcus
*Attorney, Agent, or Firm*—J. L. Jones, Sr.

[57] ABSTRACT

A two piece decorative cake container is adapted in dimensions to completely cover a cake, and the cake container is appropriately decorated to provide the decorations suitable for a specific celebration. The invention can include suitable removable decorations, such as names, dates and the like on the cake container.

2 Claims, 2 Drawing Figures

DECORATIVE CAKE CONTAINER

BACKGROUND OF THE INVENTION

Carlson, in U.S. Pat. No. 2,758,458 issued Aug. 14, 1956 discloses a cake cover with a base. The cake cover has recessed receptacles in the top of the cake cover useful for receiving candles. Brown, in U.S. Pat. No. 2,061,957 issued Nov. 24, 1936 discloses a cake box having an annular trough disposed circumferentially around a cake plate base, the trough holding water. In U.S. Pat. No. 1,935,831 issued Nov. 21, 1933, Cunnigham discloses a birthday cake plate having a cake cover with recessed receptacles in the cover suitable for holding candles.

SUMMARY OF THE INVENTION

A decorative cake cover has not more than two cover sections, a protective and decorative tubular wall section and a protective and decorative top cover section. The tubular wall section and the top cover are adapted to index and secure together, and to form a protective and decorative cover for any shape and size of cake. The tubular wall section can be appropriately cross-sectionally shaped and dimensioned to surround any selected cake configuration. The tubular wall section can have more than one indexable cover, which can be removably suitably secured on the top face of the wall section and indexed thereto, easily providing a decorate cake for specific celebration occasions.

The top cover section and the tubular wall section can be permanently decorated in three-dimensional figures, such as flowers, words, figurines, and the like. The figures can be formed of colored plastic and the like. There can be appropriate three dimensional figures as listed above, which can be temporarily cooperatively secured to the top cover by pressure sensitive adhesive. The temporary decorative figures can be removed after use, and re-affixed in another decorative array for a later celebration.

The cake cover sections can be transparent or colored plastic as selected.

Included in the objects of this invention are:

To provide a two-piece cake cover which can provide a replaceable variety of cake decorations for specific celebrations.

To provide more than one easily replacable decorative cake top cover for a decorated cake.

To provide cooperative decorative figures, legends, and the like to a cake container, adhering the decorations by sensitive adhesive.

Other objects and advantages of this invention are taught in the following description and claims.

BRIEF DESCRIPTION OF THE DRAWINGS

The description of this invention is to be read in conjunction with the following drawings.

DESCRIPTION OF THE PREFERRED EMBODIMENT OF THE INVENTION

Figure 1:
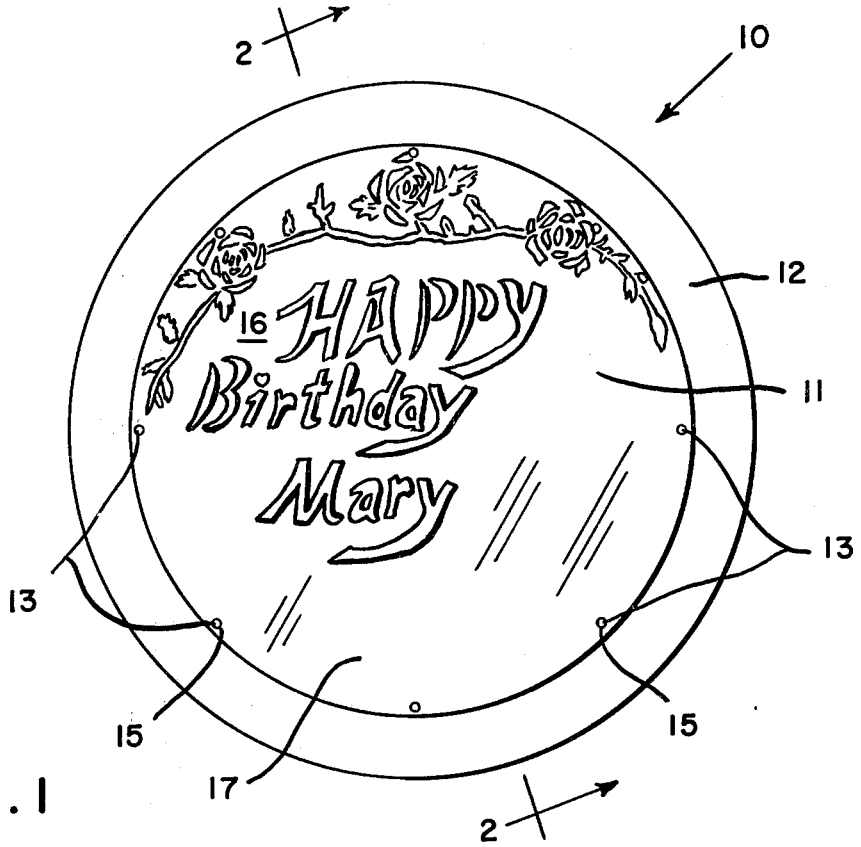
FIG. 1 is a plan view of a decorative cake container of the invention.
Figure 2:
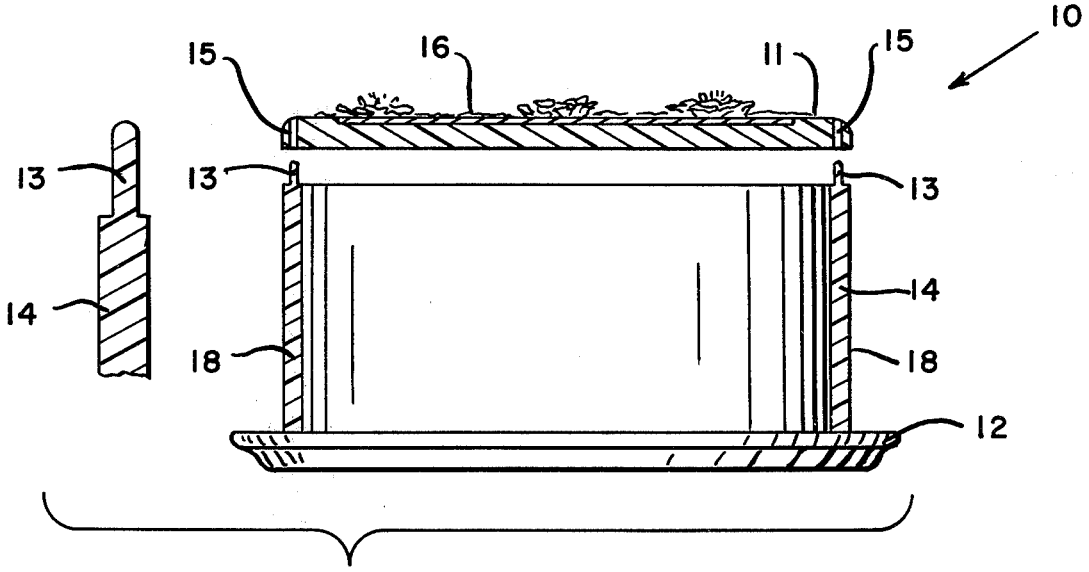
FIG. 2 is an exploded and sectional elevational view of the cake container of this invention.

A decorative cake container 10 is illustrated by a plan view of the container top cover 11 in FIGS. 1 and 2. A plate 12 provides a conventional support base for a cake, which can be disposed thereon. A multiplicity of index pins 13 are disposed at selected angular positions around and as an integral part of the cake container tubular wall section 14 providing vertical index pins for the location and securing of the top cover 11 on the tubular wall section 14. This is further illustrated in the exploded sectional elevation view of container 10 in FIG. 2.

The index pins 13, or other pins, extend vertically exteriorly above the cake container top cover 11, providing pins upon which removable candle holders and other decorative indicia can be affixed. The index pins 13 are indexed in the opposed index apertures 15 disposed in the top cover 11, providing mating securing means for cover 11.

A selected exterior top area 16 of the container top cover 11 is permanently decorated with decorative indicia, such as flowers, figurines, words, or the like, in two and three dimensions. A selected exterior top area 17 of the container top cover is provided free of decorative indicia, providing a cooperative top cover area which can be decorated by indicia, removably secured by pressure sensitive adhesive. Area 17 can provide personalized greeting and celebration indicia for an occasion, secured by the removable pressure sensitive adhesive. Likewise, the exterior wall 18 of the tubular section 14 can have removable indicia adhesively secured thereon.

The decorative cake container 10 can have a round shape as illustrated in FIGS. 1 and 2, or it can be shaped in any specified geometrical figure, having a matching shaped top cover 11 and tubular wall section 14 shaped as required. The dimensions of 11 and 14, and their equivalents, can be the required values.

A suitable selection of individual decorations, words and alphabet are cooperatively provided for, temporarily adhering to the exterior top area 17, utilizing pressure sensitive adhesive.

The cake container 10 is easily assembled, easily cleaned after use, and quickly decorated for an appropriate occasion. The container 10 can be transparent or colored plastic, as required.

Many modifications in the decorated cake container can be made in the light of my teachings. It is understood that within the scope of the claims, the invention can be practiced otherwise than as described.

I claim:

1. A decorative cake container in combination comprising:

a tubular wall section having a wall adapted in tubular wall outline and dimension to specified values for containing a cake, a multiplicity of index pins angularly disposed at selected positions around the top periphery of said tubular wall section and integrally extending vertically above said top periphery, and, at least one top cover for said tubular wall section having a planar outline adapted to and conforming to said tubular wall outline, said at least one top cover removable from said tubular wall section, said at least one top cover having permanent three dimensional decorative indicia disposed on the exterior of said top cover, said at least one top cover having a selected exterior area thereon adapted to receive removable decorative indicia, said at least one top cover having multiple index apertures angularly disposed at selected positions around the periphery providing mating index receptacles for said multiple index pins.

2. In the combination set forth in claim 1, the further modification wherein decorative indicia having pressure sensitive adhesive means thereon are cooperatively provided for said cake container.

* * * * *